US005269404A

United States Patent [19]

Wischusen, III et al.

[11] Patent Number: 5,269,404

[45] Date of Patent: Dec. 14, 1993

[54] SLEEVE AND TRAY ASSEMBLY

[75] Inventors: Henry Wischusen, III, Lilburn, Ga.; George S. Seegers, Jr., Weddington, N.C.

[73] Assignee: Rock-Tenn Company, Norcross, Ga.; a part interest

[21] Appl. No.: 829,347

[22] Filed: Jan. 31, 1992

[51] Int. Cl.[5] ..... B65D 5/50

[52] U.S. Cl. ..... 206/45.15; 229/9; 229/123.1; 229/123.2; 229/245

[58] Field of Search ..... 229/123.1, 123.2, 245, 229/212, 125.08, 125.14, 131, 9, 10, 11, 19, 20; 206/45.15; 426/106, 115, 121

[56] References Cited

U.S. PATENT DOCUMENTS

| | | | |
|---|---|---|---|
| 1,771,706 | 7/1930 | Cavanagh | 229/9 X |
| 1,862,829 | 6/1932 | Roempler | 229/9 X |
| 2,051,027 | 8/1936 | Countryman | 229/9 |
| 2,470,270 | 5/1949 | Srofe | 229/20 X |
| 3,385,501 | 5/1968 | Chang | 229/125.35 X |
| 3,615,707 | 10/1971 | Filz | 229/123.2 X |
| 3,688,897 | 9/1972 | Judd | 229/9 X |
| 3,711,011 | 1/1973 | Kugler | 229/123.1 X |
| 3,759,720 | 9/1973 | Young | 229/9 X |
| 3,893,566 | 7/1975 | Ross | 229/125.08 X |
| 3,899,079 | 8/1975 | Seiter | 229/123.2 |
| 3,918,608 | 11/1975 | Faller | 229/242 X |
| 3,974,956 | 8/1976 | Delang | 229/20 |
| 4,007,828 | 2/1977 | Mayled | 229/9 X |
| 4,517,206 | 5/1985 | Murphy et al. | 229/9 X |
| 4,573,614 | 3/1986 | Ozawa | 206/525 X |
| 4,592,914 | 6/1986 | Kuchenbecker | 206/45.15 X |
| 4,673,126 | 6/1987 | Hambleton | 229/125.08 X |
| 4,909,390 | 3/1990 | Raine et al. | 206/811 X |
| 4,930,682 | 6/1990 | Gordon et al. | 229/125.08 X |
| 5,119,940 | 6/1992 | Grindrod | 229/19 X |

FOREIGN PATENT DOCUMENTS

| | | | |
|---|---|---|---|
| 2198120 | 6/1988 | United Kingdom | 229/131 |

*Primary Examiner*—Allan N. Shoap
*Assistant Examiner*—Christopher McDonald
*Attorney, Agent, or Firm*—Jones & Askew

[57] ABSTRACT

A sleeve and tray assembly having a flexible film attached to the tray and to the sleeve such that insertion of the tray into the sleeve disposes the film into a position to cover an access opening on the tray. A levering device is provided for helping to release the film from an adhesive layer on the tray.

10 Claims, 5 Drawing Sheets

SLEEVE AND TRAY ASSEMBLY

FIELD OF INVENTION

This invention relates in general to a sealed container for storing and dispensing goods, and more particularly relates to a container comprising a sleeve and tray assembly wherein the sleeve and tray are attached by a flexible film and insertion of the tray into the sleeve forces the film to a position to cover the access opening of the tray.

BACKGROUND OF THE INVENTION

Attempts have been made in the packaging industry to provide customers with a convenient sealed container that allows both easy access to the goods in the container and a possibility of resealing the package. Such packages are useful in the medical industry as well as many other applications. For example, moistened towelettes may be dispensed in a reclosable packet, as disclosed in U.S. Pat. Nos. 4,156,493 and 4,185,754. Although the packages in these patents offer resealing, the snap-open lid may be difficult to handle for people with arthritis or with limited coordination.

A handy dispensing package is disclosed in U.S. Pat. Nos. 4,676,430 and 4,550,834. In those patents, a contanier with a tear-away portion of the top panel is disclosed. Removal of the tear-away portion converts the container into a tray with an open top for dispensing product. Although the packaging disclosed in these patents offers easy access to the product, it does not allow resealing of the package.

A common way to dispense products is the use of a tray contained in drawer-like fashion within a sleeve. Pulling the tray partially out of the sleeve allows easy access to the contents of the tray; pushing the tray back into the sleeve closes off the access opening. The sleeves may be stacked one on top of another so that many trays may be stored in a small area. Although such tray storage offers convenience and some protection for the product, it does not offer a tightly sealed package.

One way to offer a sealed container is the use of a film or foil cover adhered across the access opening of the container. An example of a tray-like container having a film cover is disclosed in U.S. Pat. No. 4,401,229. The film cover there extends past the end of the tray and is connected to a lid. Thus, the film cover serves as a seal for the tray and a hinge for the lid. The problem with the package disclosed in this patent lies in trying to remove the film cover. Removal of such adhered covers, made of aluminum or plastic foil, may be difficult even for the highly coordinated. First, breaking the initial seal can be difficult. In addition, the foil may be slippery and hard to grip. Strong adhesives add further difficulty because the cover does not easily release from the adhesive. U.S. Pat. Nos. 2,897,962 to Zackheim and 5,002,223 to Bolte disclose packages with tabs to aid in removing a cover. Zackheim discloses a multi-compartment package where each of the compartments is sealed and the seal for each compartment may be opened without contaminating other compartments. The compartments are sealed by a thin cover which has perforations to separate the covers on the different compartments. The separate compartments are provided with a rigid end that breaks away with the sealing cover and provides a handle with which to remove the cover. Bolte discloses a package with an outwardly projecting opening tab. The foil tab is attached to a tear-away foil cover and provides a means for starting the tear and a handle to pull the cover off. Although the tabs disclosed in each of these references aid in handling the foil removal, the tabs do not aid in breaking the seal between the cover and the container. Instead, the tab breaks away from an initial position and provides a handle to remove the cover.

Thus, there is a need for an easier means for removing adhered film covers. In addition, there is a need for a convenient resealing means for a package, particularly one that can be used with a tray which slides out of a sleeve to dispense product from time to time.

SUMMARY OF THE INVENTION

The present invention provides a sleeve and tray assembly wherein the tray is inserted into the sleeve. The tray defines an access opening for receiving a product to be dispensed. A flexible film is attached at a first location along the film to the tray and attached at a second location along the film to the sleeve. The tray, sleeve and film are situated such that insertion of the tray into the sleeve disposes the film into a position to cover the access opening on the tray. A resealable adhesive may be provided around the periphery of the tray so that the tray may be resealed. Each time the tray is pulled out of the sleeve, the film is automatically removed from at least a part of the access opening. Subsequent reinsertion of the tray disposes the film so as to cover the access opening.

The present invention further provides a levering device for removal of a film cover from the periphery of an access opening. Generally described, the cover is comprised of two parts, a first flexible portion and a second rigid portion. The second portion comprises an edge which contacts at least two points along the periphery of the access opening with the points lying along a line which crosses a portion of the access opening. Application of pressure to the underside of the levering device causes the seal between the cover and the periphery of the access opening to break below the second portion, allowing easy removal of the rest of the cover.

Thus, it is an object of the present invention to provide an improved container for holding and dispensing products.

It is a further object of the invention to provide a sleeve, cover and tray assembly which provides easy access to contents and resealing capability.

Another object of the present invention is to provide a means for aiding removal of an adhered cover from a container.

Yet another object of the present invention is to provide a levered action to remove an adhered film from a container.

Other objects, features, and advantages of the present invention will become apparent upon reading the following detailed description of a preferred embodiment of the invention, when taken in conjunction with the drawings and appended claims.

DETAILED DESCRIPTION OF PREFERRED EMBODIMENT

Figure 1:
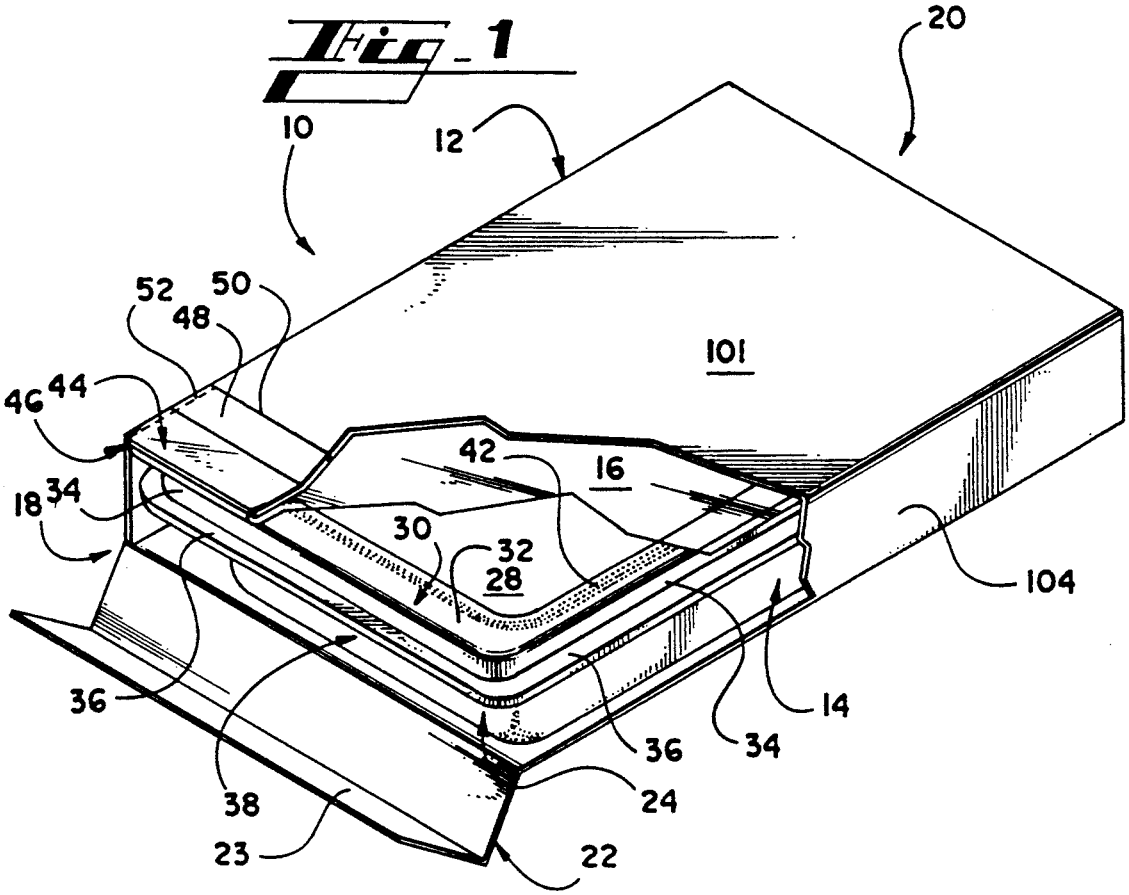
FIG. 1 is a pictorial view of the sleeve and tray assembly of the present invention, with portions cut away to show interior detail.

Turning now to the drawing, in which like numerals represent like parts throughout the several views, FIG. 1 shows a partially cutaway pictorial view of a preferred embodiment of the sleeve and tray assembly 10 of the present invention. The assembly 10 of the embodiment shown is comprised of three main parts: a sleeve or box 12, a tray 14, and a clear film sheet 16.

The sleeve or box 12 of the embodiment shown is a paperboard box, although any suitable material may be used to form the sleeve 12. The box 12 defines a forward, tray-receiving open end 18 and a rearward enclosed end 20. In this embodiment, the rearward end 20 is closed off to form a five-sided container. A front panel 22 is attached at the forward end 18 for completely closing off the box 12 when the tray 14 is inserted.

Figure 6:
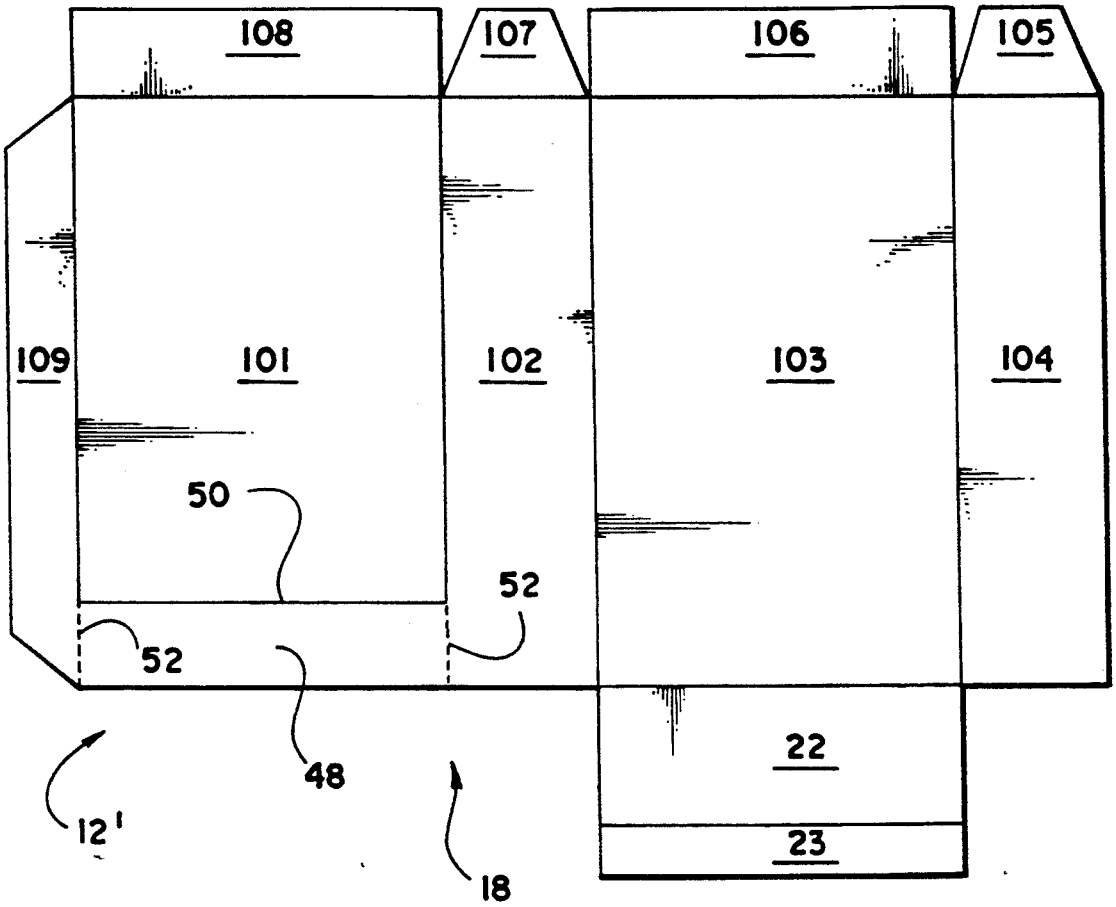
FIG. 6 is a plan view of a blank for the box to be used for the sleeve and tray assembly of FIG. 1.

A blank 12' from which the box 12 is formed is shown in FIG. 6, with the inside of the box 12 facing upward. The sleeve 12 is formed by a top panel 101, bottom panel 103, and two side panels 102 and 104. A glue flap 109 is adhered to the panel 104 in a conventional manner to hold together the sleeve section. The rearward end 20 of the box is comprised of four flaps 105, 106, 107 and 108, which are adhered together to close off that end. At the front end 18 of the box 12 the panel 22 is foldably connected to and extends outwardly from the bottom panel 103. A glue panel 23 extends beyond the main portion of the panel 22. The glue on this panel 23 may be a pressure sensitive sealant, so that the tab may be closed again after opening. The front end of the top panel 101 has a transverse score 50 spaced rearwardly a short distance from the front end. Two tear scores 52, the purpose of which will be discussed below, are formed along the folds between the top panel 101 and the side panels 102 and 104, extending from the score 50 to the front end 18 of the sleeve 12.

Figure 4:
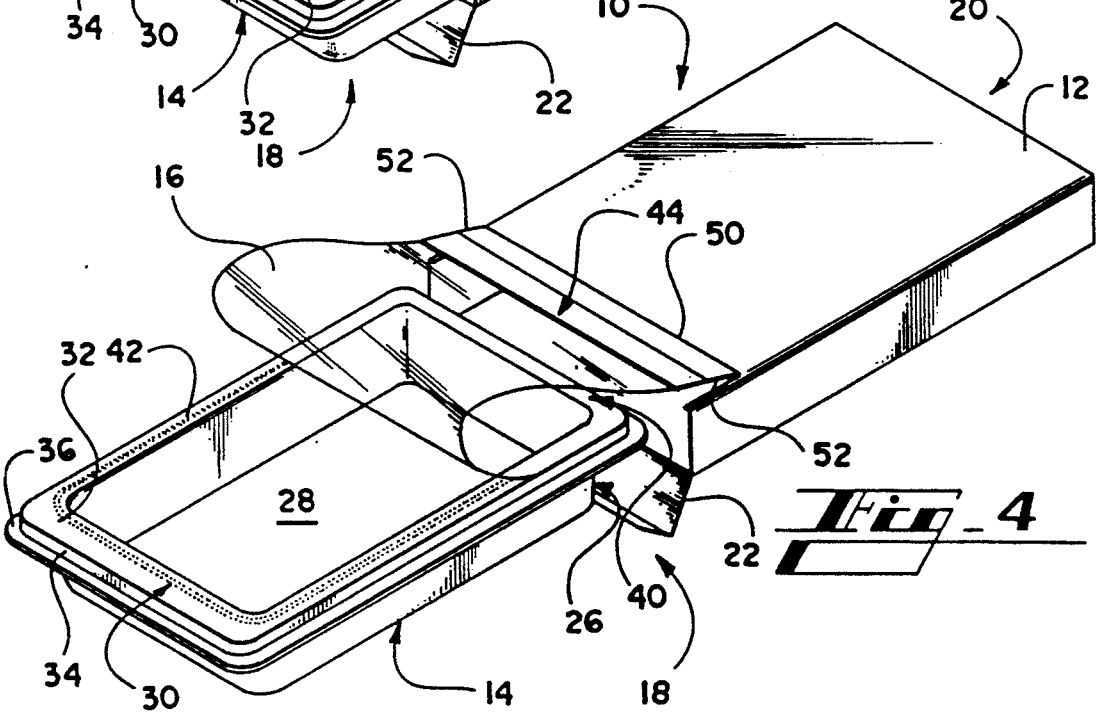
FIG. 4 is a pictorial view of the container of FIG. 1 with the tray pulled all the way out of the sleeve.

Referring now to FIG. 4, the tray 14 of the embodiment shown is a shallow, rectangular tray having a handle end 24 and a film attachment end 26. The tray 14 is preferably formed of plastic and is closed on the bottom and sides, with the top unobstructed to form an access opening 28. It should be understood that the tray may be formed of other materials, and need not be molded in one piece as shown. The access opening 28 may be of any size or configuration, and in the shown embodiment consists of the whole top side of the tray. Around the periphery of the access opening 28 a flange 30 is formed for receiving the film cover 16. The flange 30 runs substantially parallel to the bottom of the tray 14 and defines a flat annular surface 32. In the embodiment shown, the flange 30 has reinforcement in the form of a vertical rim 34 and a second horizontal rim 36, which extend successively downwardly and outwardly from the flange. The flange 30 extends farther out on the front end 24 of the tray than along the sides, to form a handle 38 for a person to grasp to pull the tray 14. The handle portion 38 extends out far enough so that a person may get his or her fingers behind the vertical reinforcement 34.

Figure 3:
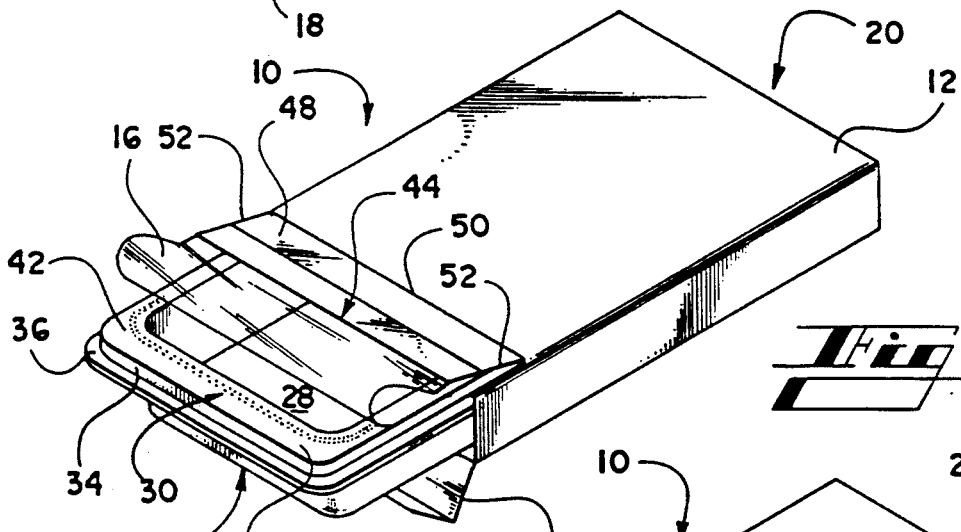
FIG. 3 is a pictorial view of the container of FIG. 1 with the tray partially pulled out of the sleeve.

The flexible film 16 of the present invention may consist of aluminum foil, plastic film, paper, a woven material, a laminate of paper with foil, plastic film or both, or any other suitable flexible material. In the preferred embodiment shown, the film 16 is a clear, flexible plastic film made of polyester or high density polyethylene. The film preferably has sufficient stiffness to remain essentially flat across the tray without central support. The film 16 is attached with an adhesive to the flange 30 along the attachment end 26 of the tray 14, and may be permanently adhered all the way across the top rear end of the flange at the area designated generally at 40, as is best seen in FIG. 4. A resealable adhesive 42 is located on the front and side portions of the flat upper surface 32 of the flange 30 for communication with the film 16. The resealable adhesive 42 may be used along the attachment end on the area 40. Furthermore, the flange surface 32 may be broadened at the attachment end 26 to increase the grip of adhesive 42 in that area. The adhesive 42 is a conventional resealable adhesive and may contain ethylene vinyl alcohol for pealability. The film 16 is also permanently attached to the sleeve 12. Preferably, this second permanent attachment is at the tray-receiving end 18 of the sleeve 12, along a strip of the top panel 101 designated generally at 44, as is best seen in FIG. 3.

Figure 2:
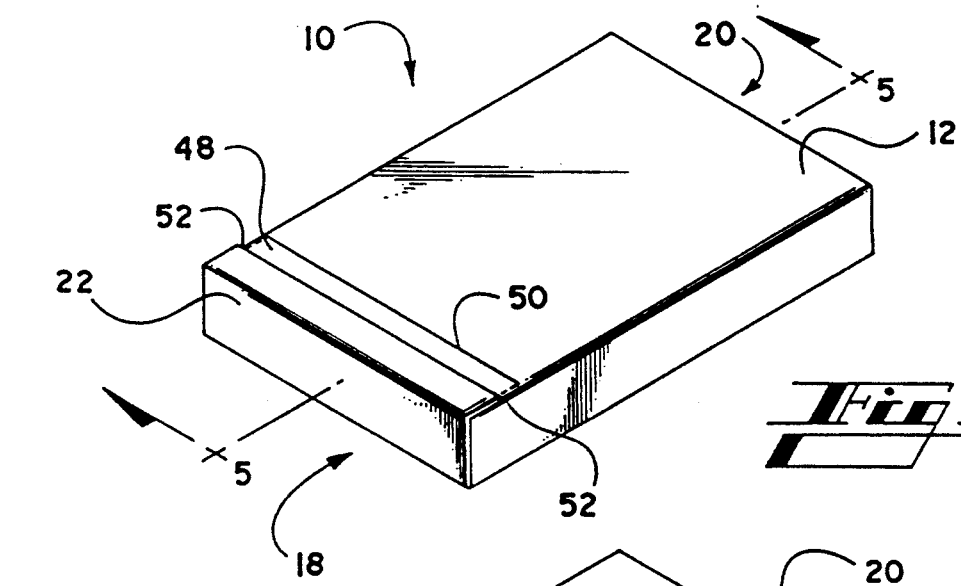
FIG. 2 is a pictorial view of the container of FIG. 1, showing the tray inserted inside the sleeve with the flap closed.

Manufacture and assembly of the assembly 10 is as follows. The tray 14 is loaded with product and sealed by the film 16. The film 16 extends past the handle end 24 of the tray 14. The sealed tray 14 is then inserted into the box 12 and the excess film 16 is glued to the outer surface of the top panel 101 at the strip designated generally at 44. As a last step in manufacturing, the flap 22 is raised and pressure is applied to the pressure sensitive adhesive on the flap 23 to close the box 12. The sealed assembly 10 as shown in FIG. 2 with product is now ready to be shipped to a user. An alternative method of manufacture would be to assemble the box 12 around the sealed tray 14.

Figure 5:
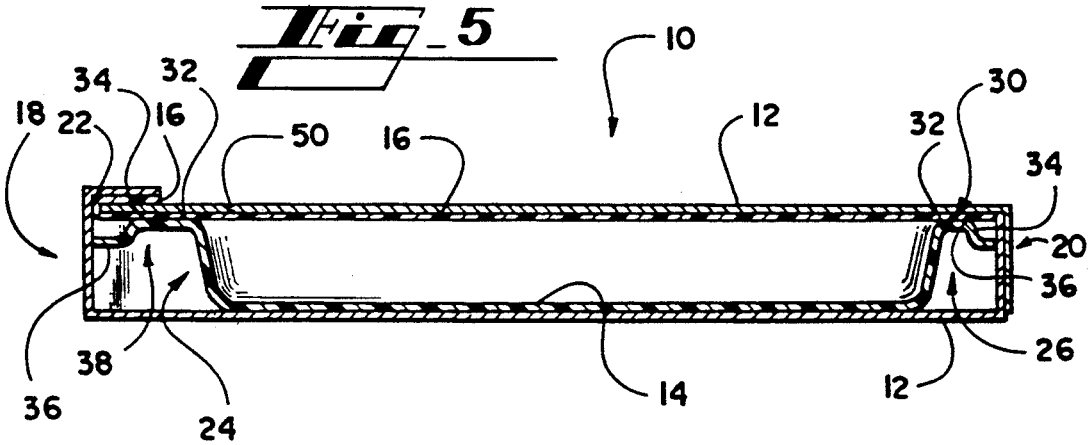
FIG. 5 is a side cross-sectional view of the tray of FIG. 1 taken along the line 5—5 of FIG. 2.

Operation and use of the assembly 10 is as follows. The flap 22 is opened and the tray 14 is then ready for removal. Gripping the tray 14 behind the handle 38 and pulling the tray 14 breaks the temporary seal of the adhesive 44 along the handle portion 38 of the flange 30 and starts the tray 14 out of the sleeve 12. Further pulling causes the full access opening 28 to be exposed and allows access to the contents of the tray 14. The tray 14 may be reinserted into the sleeve 12 by simply pushing the tray 14 back into the sleeve 12. Once the tray begins entering the box 12 the film 16 is pressed back against the flange 30 by the pressure of the top panel of the box 12 against the tray 14. This creates a seal between the adhesive 42 and the film 16. The tray 14 is shown in a half-inserted position in FIG. 3. When the tray is completely inserted, the film 16 is stretched flat against the surface of the flange 30, sealing off the tray 14. At this point the panel 22 may be reclosed, completely closing off the box 12, as is shown in FIG. 2. As can be seen in FIG. 5, the film 16 extends the length of the flange 30 and folds over the front edge of the top panel 101.

In order to prevent the tray 14 from being pulled out all the way, a stop (not shown) may be introduced. The stop may consist of a simple extension downward from the flange 30, which upon pulling the tray outward in the sleeve 12 hits a corresponding stop attached to or formed in the interior side wall of the sleeve 12. A suitable sleeve stop is shown in U.S. Pat. No. 4,511,042, which is incorporated herein by reference.

Figure 7:
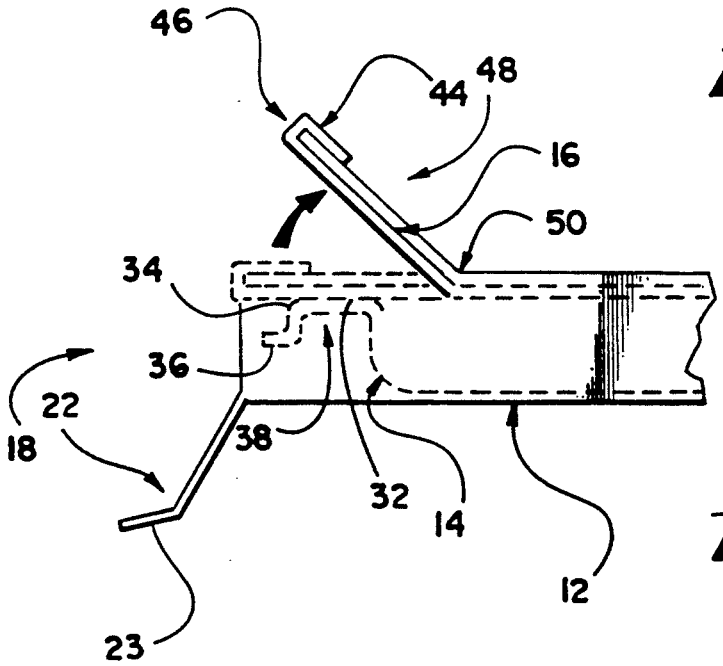
FIG. 7 is a side view of the levering device for the present invention.

Breaking the initial seal may be difficult, because of the tackiness of the adhesive and the lack of leverage in breaking the seal. In response to this problem, a sleeve and tray opening lever 48 is introduced. The lever 48 is preferably a part of the top panel 101 and is located at the tray-receiving end 18 of the sleeve 12, including the area 44 to which the film 16 is permanently attached. The lever 48 is released from the plane of the top panel 101 by breaking the tear scores 52 so as to allow a hinging action to occur about the score 50. If the lever 48 is used, it is preferred that the sleeve 12 extend slightly past the front end 24 of the tray 14. The operation of the lever 48 is such that pressure on the underside of this extension causes the initial seal of the film 16 and the adhesive 42 to release. Since the hinge line of the score 50 contacts two points of the flange 30, pushing upward on the bottom edge allows a levering action to detach the film 16. This action is best depicted in FIG. 7. The tray 14 may then be pulled easily out of the sleeve 12, as the film peels off the side portions of the flange 30.

As can be seen by FIGS. 3 and 4, the lever remains in a slightly upward position during removal of the tray 14. Once the tray 14 is fully reinserted, the lever is held back in place by the glue panel 23 on the front panel 22.

Figure 8:
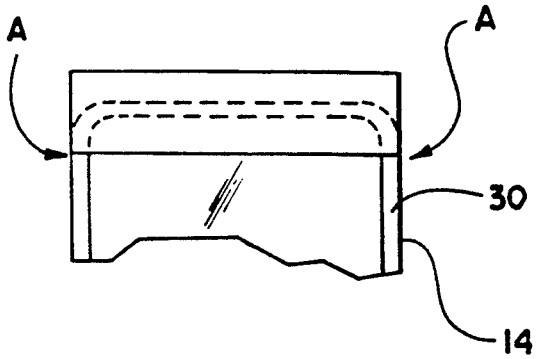
FIG. 8 is a diagrammatic top plan view of the levering device of FIG. 7.
Figure 9:
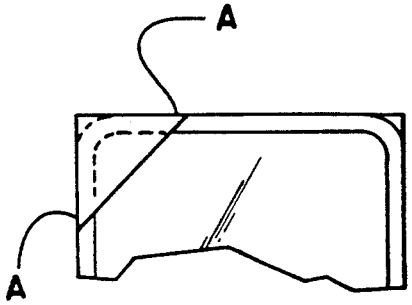
FIG. 9 is a diagrammatic top plan view of an alternate embodiment of the levering device of FIG. 7.

The opening lever 48 of the present invention may be used in conjunction with any container which defines an access opening and has a flexible cover closing off that opening. FIGS. 8 and 9 show two embodiments of trays where a cover with the levering device of the present invention is included. As can be seen from the drawings, it is not necessary that the rigid portion of the levering device cover the width of the tray 14, but it is important that the rigid piece cross two leverage points "A" of the access opening periphery 30 and cross the access opening 28. Upon pushing up the rigid portion in either of these two embodiments, a levering action occurs and the seal of the tray releases.

Figure 11:
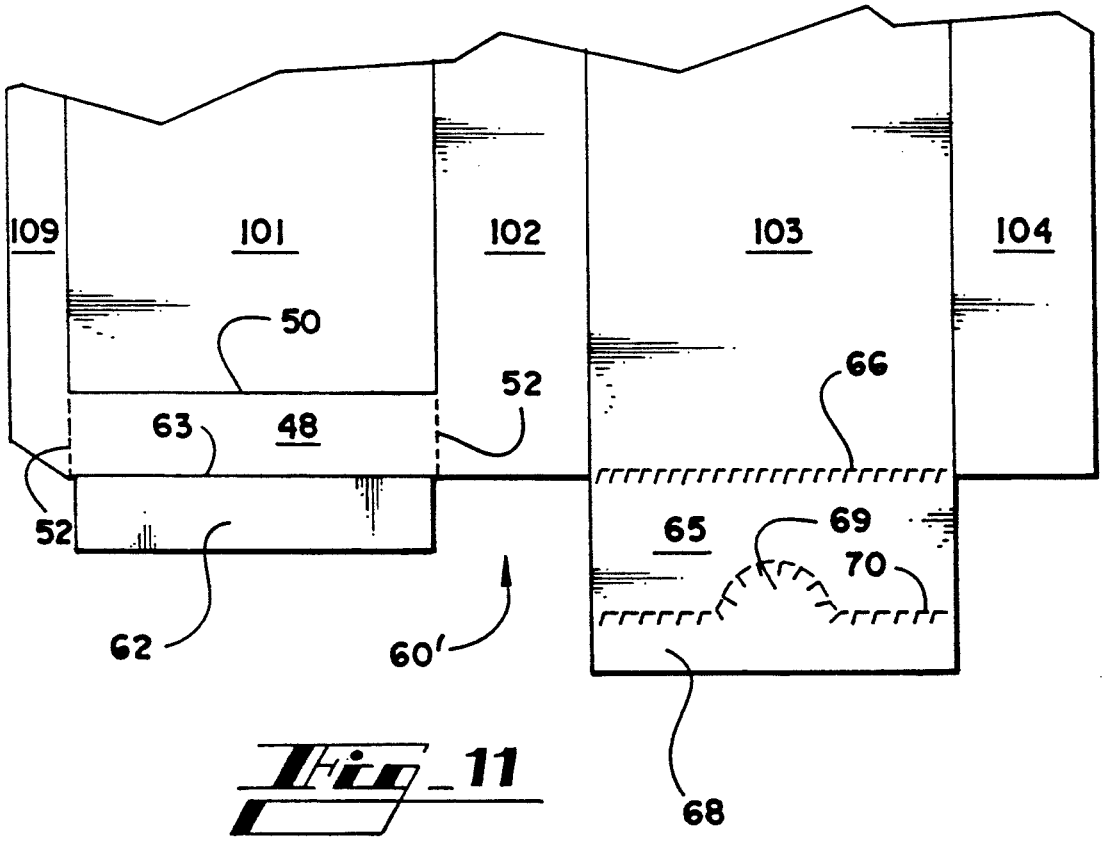
FIG. 11 is a plan view of a blank for forming the sleeve of FIG. 10.
Figure 10:
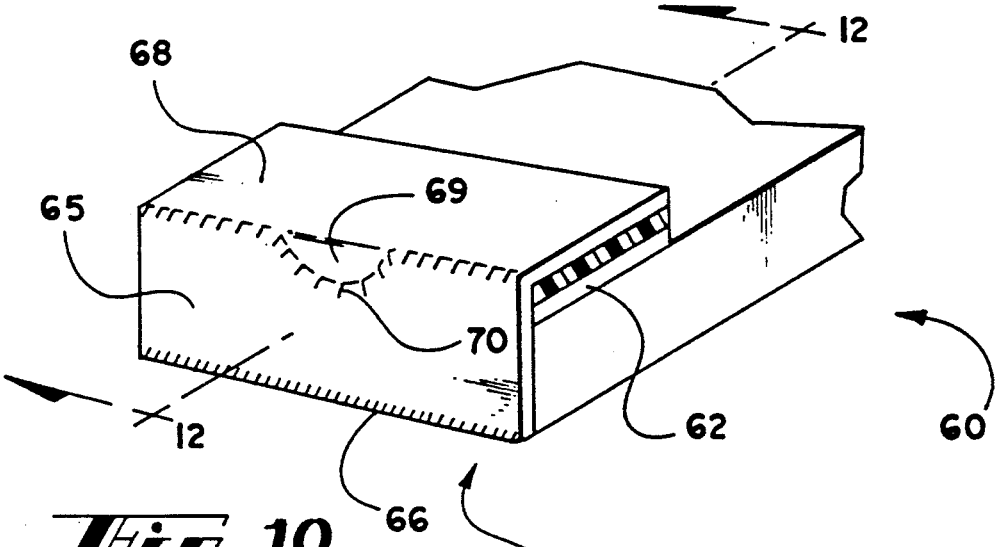
FIG. 10 is a partial pictorial view of an alternate embodiment of a sleeve and tray assembly embodying the invention.
Figure 12:
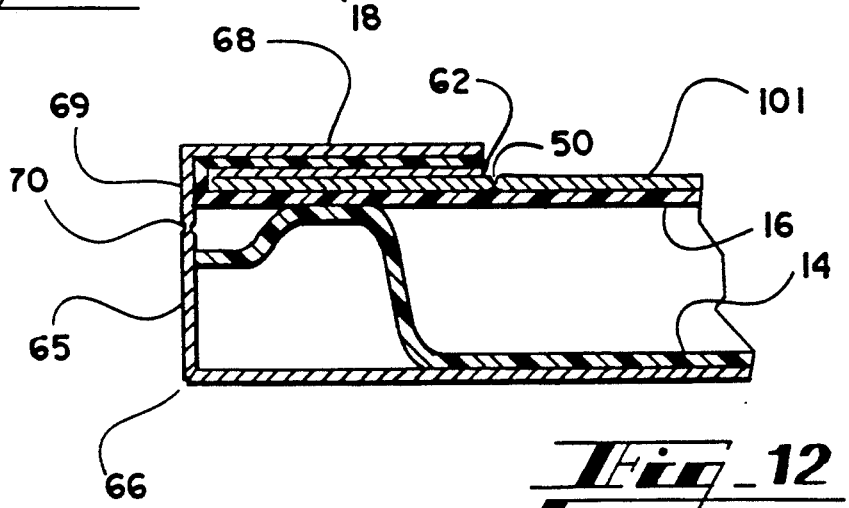
FIG. 12 is a side cross-sectional view taken along line 12—12 of FIG. 10.
Figure 13:
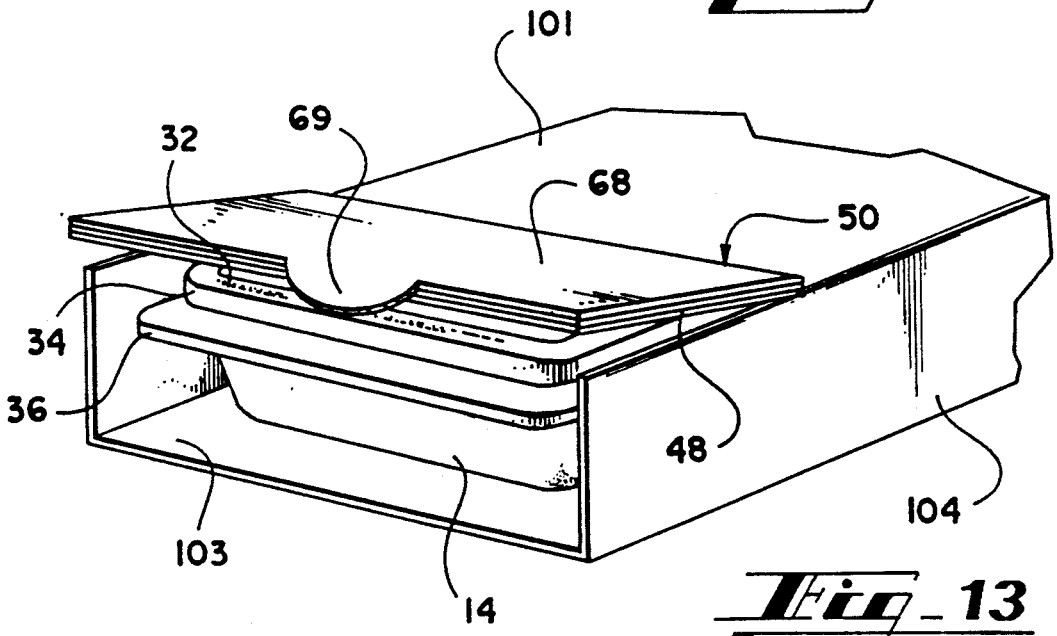
FIG. 13 is a partial pictorial view of the assembly of FIG. 10 with the front panel removed.

An alternate embodiment 60 of the assembly 10 is shown in FIGS. 10–13. A blank 60' for the alternate embodiment 60 is shown in FIG. 11. The blank 60' includes an extension 62 which is attached along a score 63 to the levering panel 48. The extension 62 is folded outside the box and is adhered to the top of the levering panel 48. This extension 62 strengthens the levering panel 48 and facilitates bonding of the film 16.

The embodiment 60 also includes a tear away panel 65 on the front end 18 of sleeve 12. A zipper score 66 is located between the bottom panel 103 and the tear away panel 65. The panel 65 is attached to the top of the film 16 lying on the levering panel by a glue panel 68. A tab 69 consisting of material removable from the glue panel 68 extends downward from the glue panel 68. A zipper score 70 divides the panel 68 and the tab 69 from the tear away panel 65.

The final assembly of the front end 18 of the alternate embodiment 60 consists of many layers, giving strength to the levering panel 48. The extension 62 folds over the panel 101. The film then folds around and is glued to the top of the extension 62. The tear away panel 65 is folded to enclose the forward end of the sleeve, and the panel 68 is adhered permanently above the film 16.

In order to open and access the contents of the alternate embodiment 60, the panel 65 is torn away at the zipper scores 66 and 70. This leaves the tab 69 for a user to grasp and lift to create levering action at the score 50. Since the tab 69 extends past the end of the tray 14, the tray need not be recessed into the sleeve 12. Once the seal is broken, the tray may be pulled out or inserted in the manner described above in connection with the first embodiment.

It should be noted that the film 16 will help to close off the top of the tray even without the adhesive 42 along the flange 30. For example, a thicker foam sheet in place of the film 16 would be pressed against the flange 30 by the top panel 101 of the sleeve 12.

While this invention has been described in detail with regard to the preferred embodiment thereof, it should be understood that variations and modifications can be made without departing from the spirit and scope of the invention as defined in the following claims.

What is claimed is:

1. A sleeve and tray assembly, comprising:

a tray defining an access opening and a leading end and a trailing end thereon;

a sleeve shaped to slidably receive said tray, said sleeve defining a forward opening for receiving said tray and a rearward end; and a flexible film attached at a first location along said film to an area on said tray in the proximity of said leading end of said tray and adhered at a second location along said film to said sleeve, such that insertion of said leading end of said tray into said forward opening of said sleeve and continuing insertion of said tray into said sleeve causes said film to be disposed into a position to cover said access opening.

2. The sleeve and tray assembly of claim 1, wherein said film is adhered such that movement of said trailing end away from said forward opening of said sleeve causes said film to be removed from at least a portion of said access opening.

3. The assembly of claim 1, wherein said sleeve is closed at said rearward end.

4. The assembly of claim 1, wherein said film is adhered to said sleeve at said forward opening.

5. The assembly of claim 1, wherein upon insertion of said tray into said sleeve, said film is stretched flat against the periphery of said access opening.

6. The container of claim 1, wherein said sleeve includes a top panel positioned over said access opening, and said film is adhered to said top panel.

7. The assembly of claim 1, further defining a periphery around said access opening further comprising an adhesive layer substantially around said periphery, said adhesive forming a seal between said periphery and said film when said tray is inserted in said sleeve.

8. The assembly of claim 7, wherein said adhesive is resealable.

9. The assembly of claim 7, wherein said sleeve further comprises a rigid hinged section, said hinge contacting at least two points spaced along the periphery of the access opening when said tray is inserted, said points lying along a line which crosses a portion of the access opening, said hinged section being connected to said film and providing leverage to raise a part of said forward opening of said sleeve so as to break said seal between said film and said adhesive and to remove at least a part of said film from said tray.

10. A sleeve and tray assembly, comprising:

a tray defining an access opening with a periphery therearound;

a sleeve designed to slidably receive said tray and defining a forward opening for receiving said tray, a rearward end, a top panel, and a bottom panel;

a flexible film attached at a first location along said film to the first inserted end of said tray and adhered at a second location along said film to said top panel at said forward opening of said sleeve; and an adhesive layer substantially around said periphery, such that insertion of said tray into said sleeve disposes said film into a position to cover said access opening and said adhesive forms a seal between said periphery and said film.

* * * * *